US007096940B2

(12) United States Patent
Baxter et al.

(10) Patent No.: US 7,096,940 B2
(45) Date of Patent: Aug. 29, 2006

(54) CENTRALIZER SYSTEM FOR INSULATED PIPE

(75) Inventors: Carl F. G. Baxter, Viram (DK); Christopher S. Caldwell, The Woodlands, TX (US); Robert E. Rose, Jr., Pearland, TX (US); Brent L. Dyer, Missouri City, TX (US); Michael Beard, Spring, TX (US); Roy Daniel Avery, Jersey Village, TX (US)

(73) Assignee: RTI Energy Systems, Inc., Spring, TX (US)

( * ) Notice: Subject to any disclaimer, the term of this patent is extended or adjusted under 35 U.S.C. 154(b) by 82 days.

(21) Appl. No.: 10/689,479

(22) Filed: Oct. 20, 2003

(65) Prior Publication Data

US 2005/0082056 A1 Apr. 21, 2005

(51) Int. Cl.
*E21B 17/10* (2006.01)

(52) U.S. Cl. ..... 166/241.6; 175/325.7; 166/242.4

(58) Field of Classification Search ..... 166/241.1, 166/241.6, 242.1, 242.4, 242.6; 175/325.1, 175/325.5, 325.7; 138/110, 145
See application file for complete search history.

(56) References Cited

U.S. PATENT DOCUMENTS 3,623,968 A * 11/1971 Bohne ..... 204/196.15
3,697,141 A * 10/1972 Garrett ..... 175/325.5
3,990,478 A * 11/1976 McFarland ..... 204/196.15
4,185,694 A 1/1980 Horton
4,633,801 A 1/1987 Marshall
5,336,020 A 8/1994 Askestad
5,803,193 A * 9/1998 Krueger et al. ..... 175/325.1
5,806,615 A * 9/1998 Appleton ..... 175/325.7
5,873,677 A 2/1999 Davies et al.
5,901,798 A * 5/1999 Herrera et al. ..... 175/325.3
6,032,748 A * 3/2000 DeBray et al. ..... 175/325.7
6,305,723 B1 10/2001 Schutz et al.
6,422,316 B1 7/2002 Schutz et al.
6,422,791 B1 7/2002 Pallini, Jr. et al.
6,467,545 B1 10/2002 Venkataraman et al.
2002/0084077 A1 7/2002 Finn et al.
2003/0021634 A1 1/2003 Munk et al.

OTHER PUBLICATIONS

Spar Global Responses, Prepared for OGP Workshop—The Metocean and Engineering Technology Requirements for Floating Systems—Apr. 23, 2001, John Halkyard, CSO Aker Engineering, Inc., The Coflexip Stena Offshore Group.

* cited by examiner

*Primary Examiner*—Kenneth Thompson
(74) *Attorney, Agent, or Firm*—Browning Bushman P.C.; C. James Bushman

(57) ABSTRACT

A centralizer system is provided for use in a marine riser system with an insulated pipe, which may be a titanium stress joint. The centralizer system utilizes one or more centralizers mounted such that insulation material is provided in an annulus between the one or more centralizers and the stress joint. A clamp is utilized to axially affix either one centralizer or multiple centralizers to the stress joint. The clamp is comprised of a plurality of sections with cylindrical interior surfaces which are tightened together using fasteners. The cylindrical interior surfaces avoid damage to the insulation layer which may be elastomeric. The clamp and each centralizer have radially directed projections thereon which interlock the clamp with each centralizer. Because the clamp is axially affixed, the centralizer is then also axially affixed. In one embodiment, the centralizer is axially moveable to a desired axial position prior to being interlocked to the tightened clamp.

17 Claims, 3 Drawing Sheets

FIG.1
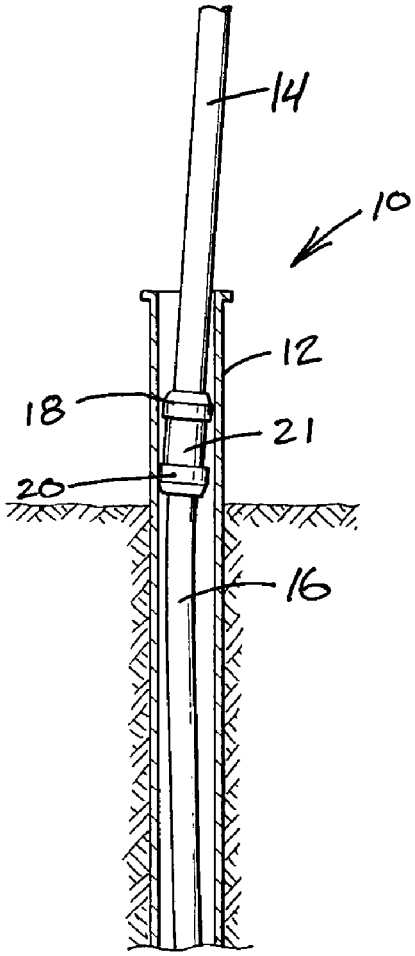
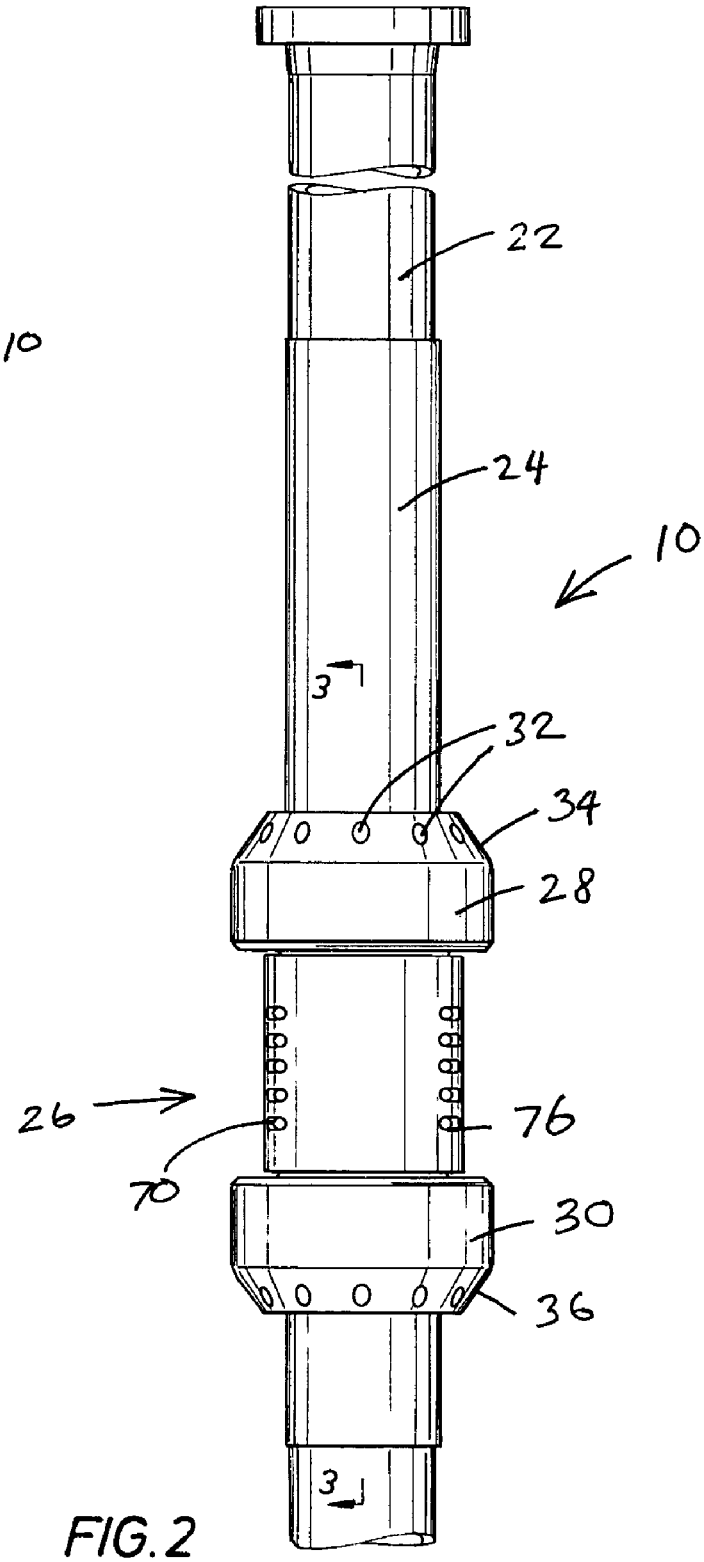
FIG.2

FIG. 3
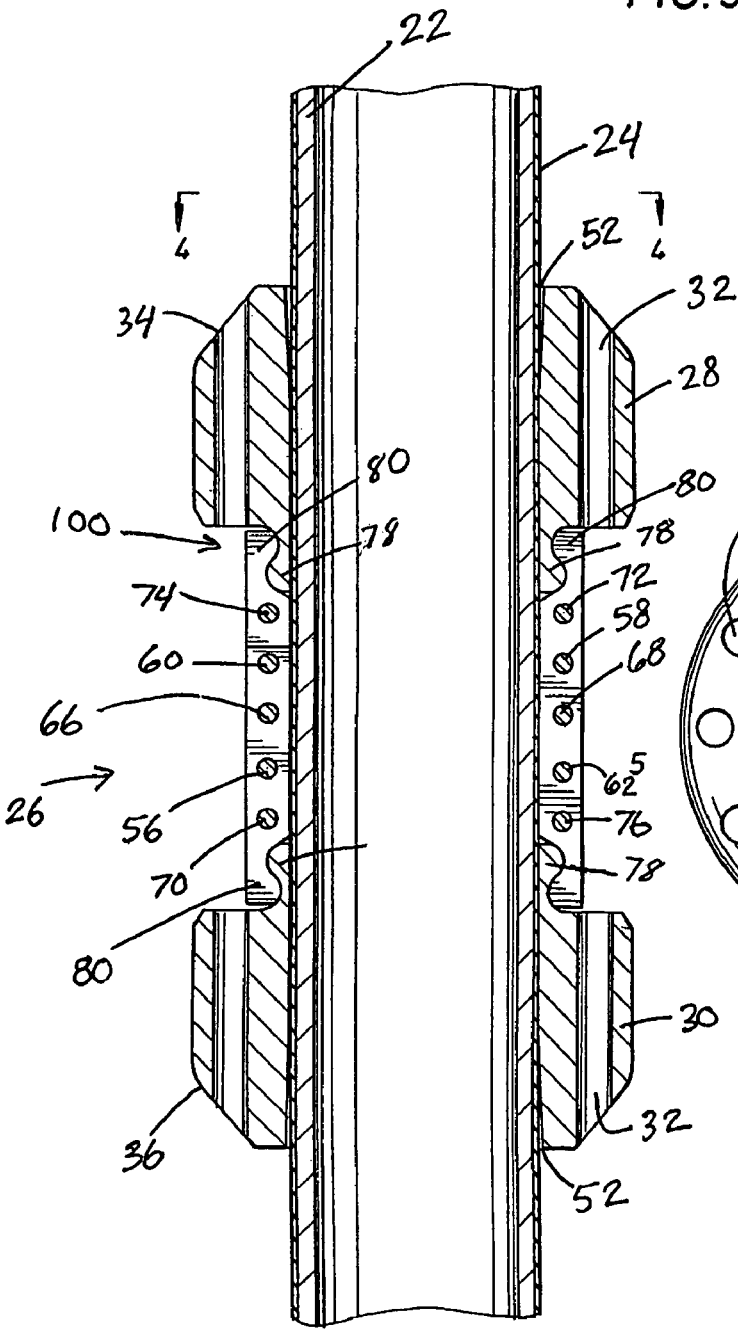
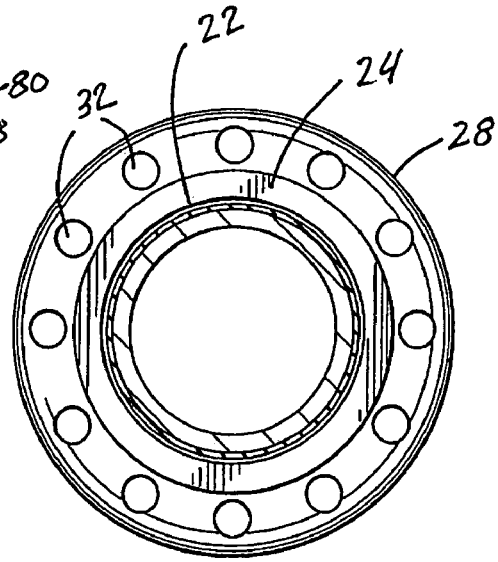
FIG. 4

CENTRALIZER SYSTEM FOR INSULATED PIPE

BACKGROUND OF THE INVENTION

1. Field of the Invention

The present invention relates generally to high-load centralizer systems and, more specifically, provides a system for securing one or more centralizers to a pipe coated with elastomeric or other suitable insulation material which in one preferred embodiment may be utilized as non-fixed riser interconnection or stress pipe riser interconnection between a floating platform and/or a subsea wellbore.

2. Description of the Prior Art

Marine risers have been utilized in the past with non-fixed riser interconnections, also referred to herein sometimes as stress joints and/or keel joints, which provide riser interconnections to floating platforms and/or drill ships and/or wellheads. A stress joint utilized adjacent the floating platform may sometimes be referred to herein as a keel joint because it extends through the bottom or the keel of the platform or other marine vessel. As used herein floating platform may refer to any marine structure. The floating platforms are generally maintained above the wellhead, or in the general vicinity of a plurality of wellheads. One type of non-fixed connection for this purpose is described in some detail in U.S. Pat. No. 4,185,694, issued Jan. 29, 1980, to E. E. Horton, which is incorporated herein by reference. More specifically U.S. Pat. No. 4,185,694 provides for a marine riser system which extends between a floating offshore platform and one or more well means in a seabed formation and which has riser end portions non-fixedly connected in to the floating platform and to wellhead structure at the well hole. Each end portion of the riser may be adapted to yield axially, laterally, and rotatively during movement of the riser relative to the platform and to the wellhead structure. Each end portion of the riser is provided with fulcrum or pivot contacts, which may preferably comprise centralizers, with hawse pipe carried by the platform and with hawse pipe or casing means provided in the wellhead structure. Bending stresses at the riser end portions or stress joints are reduced at the platform and at the wellhead structure by utilizing the non-fixed connection described in greater detail therein.

The non-fixed connections, which may also be referred to herein as stress joints, utilize centralizers which are subject to considerable forces, as the centralizers act as fulcrums as described in the above cited U.S. Pat. No. 4,185,694. Due to the high stresses involved, over time undesirable axial slippage of the centralizers may occur with respect to the non-fixed riser connection or stress joint. Other problems with the non-fixed connections that may exacerbate the slippage of the centralizer include corrosion and/or galvanic action between for instance, the wellhead and the non-fixed riser connection or stress joint wherein the wellhead and centralizers may comprise steel and the stress joint may comprise titanium and/or steel.

U.S. Pat. No. 5,887,659, issued Mar. 30, 1999, to B. J. Watkins, discloses an assembly including a protective sleeve spaced about an intermediate pipe of a riser which is adapted to extend through an opening in the bottom of a vertical compartment of a offshore rig for use in drilling or completing a subsea well, with a ball shaped portion on the upper end of the sleeve is closely received by ball shaped surfaces of the upper portion of the riser pipe, while a ball shaped part on the lower portion of the riser pipe is so received within the lower end of the sleeve to permit them to swivel as well as to move vertically with respect to one another.

Other attempts to reduce minimize or distribute forces applied to stress joints and/or keel joints are shown in the following documents:

U.S. Pat. No. 6,422,791, issued Jul. 23, 2002, to Pallini, Jr. et al., discloses an attachment which extends between an outer sleeve and an inner riser pipe where the pipe penetrates the keel of a platform. In one version, the attachment is a conically-shaped with a small diameter ring that engages the riser pipe and a large diameter ring that engages the outer sleeve. This attachment has elements that are very flexible in bending but relatively stiff and strong in axial load. Other versions include flat rings where lateral load is taken directly into tension and compression in the beams, allowing for relatively high lateral load transfer. Both the conically-shaped attachment and the flat ring have a number of variations that provide low bending stiffness but high axial stiffness of the elements. Depending on whether resistance to axial loads, lateral loads, or resistance to combination of both loads is desired, the attachment and the flat ring may be used alone or in combination. Other variations of the device provide two opposing conical shaped attachments or a conical and flat ring attachment installed together to provide load capability in both axial and lateral directions while still providing angular flexibility.

U.S. Pat. No. 5,683,205, issued Nov. 4, 1997, to J. E. Halkyard, discloses a stress relieving joint for pipe such as risers, tendons, and the like used in floating vessel systems wherein a vessel is subject to heave, pitch, and roll motion caused by wind, currents, and wave action; the pipe passing through a constraint opening in the vessel and connected to the sea floor and subject to bending or rotation at the constraint opening. The joint comprises a sleeve member of selected length with ends at opposite sides of the constraint opening and centralizing annuli or rings at sleeve member ends for providing spaced contact points or areas to distribute bending stresses imparted to the sleeve member at the constraint opening to the pipe at the sleeve member ends.

U.S. Patent Application Publication 2002/0084077 A1, published Jul. 4, 2002, to Finn et al., discloses a spar type floating platform having risers passing vertically through the center well of a spar hull. A gimbaled table supported above the top of the spar hull is provided for supporting the risers. The table flexibly is supported by a plurality of non-linear springs attached to the top of the spar hull. The non-linear springs compliantly constrain the table rotationally so that the table is allowed a limited degree of rotational movement with respect to the spar hull in response to wind and current induced environmental loads. Larger capacity non-linear springs are located near the center of the table for supporting the majority of the riser tension, and smaller capacity non-linear springs are located near the perimeter of the table for controlling the rotational stiffness of the table. The riser support table comprises a grid of interconnected beams having openings therebetween through which the risers pass. The non-linear springs may take the form of elastomeric load pads or hydraulic cylinders, or a combination of both. The upper ends of the risers are supported from the table by riser tensioning hydraulic cylinders that may be individually actuated to adjust the tension in and length of the risers. Elastomeric flex units or ball-in-socket devices are disposed between the riser tensioning hydraulic cylinders and the table to permit rotational movement between the each riser and the table.

The above cited prior art does not disclose suitable means for prevention of axial slippage of centralizers in a stress joint which may be subject to substantial forces as well as to corrosion and/or galvanic action. Consequently, there remains a need to provide an improved centralizer system with improved centralizers and centralizer mountings that are not subject to the above problems. Those of skill in the art will appreciate the present invention, which addresses the above problems and other significant problems.

SUMMARY OF THE INVENTION

Accordingly, it is an objective of the present invention to provide an improved centralizer system especially suitable for non-fixed riser connections which may comprise or utilize stress joints.

Another objective of one preferred embodiment of the present invention is to provide an improved system and method for clamping one or more centralizers to elastomeric coated pipe.

These and other objectives, features, and advantages of the present invention will become apparent from the drawings, the descriptions given herein, and the appended claims. However, it will be understood that above-listed objectives and other described advantages and features of the invention are intended only as an aid in understanding aspects of the invention, are not intended to limit the invention in any way, and therefore do not form a comprehensive or restrictive list of objectives, features, and/or advantages. Therefore, any stated objects, features, and advantages are not intended to limit the invention in any manner inconsistent with the claims or other portions of the specification and are not intended to provide limiting language outside of the claim language. It is intended that all alternatives, modifications, and equivalents included within the spirit of the invention and as defined in the appended claims be encompassed as a part of the present invention.

Accordingly, the present invention provides a centralizer system which may preferably be positioned in a marine riser system between a wellbore and a floating platform wherein at least one of the wellbore or the floating platform may comprise a receptacle for receiving the centralizer system. The receptacle has a receptacle inner diameter. The centralizer system is operable for withstanding stresses produced by relative movement between the centralizer system and the receptacle. The centralizer system may comprise one or more elements such as for example only, a metallic pipe with a pipe outer diameter sized less than the receptacle inner diameter so as to be insertable into the receptacle and relatively moveable within the receptacle.

An insulative coating is preferably formed in surrounding relationship to the metallic pipe. One or more metallic centralizers may be mounted on the metallic pipe such that the insulative coating is annularly positioned between the one or more metallic centralizers and the metallic pipe. The one or more metallic centralizers have a centralizer outer diameter less than the receptacle inner diameter but greater than the pipe outer diameter to permit insertion thereof into the receptacle. A clamp may comprise at least two sections. Each section may comprise an internal cylindrically shaped surface for engaging the insulative coating around the metallic pipe.

One or more fasteners for the clamp are operable to tighten the internal cylindrically shaped surfaces of the at least two sections of the clamp with respect to each other around the insulative coating whereby the at least two internal cylindrically shaped surfaces of the clamp are axially fixed in position with respect to the metallic pipe.

One or more interlocking members interlock the internal cylindrically shaped surfaces of the clamp with respect to the one or more metallic centralizers to thereby prevent axial movement of the one or more metallic centralizers with respect to the metallic pipe. The one or more interlocking members may comprise at least one radially inwardly directed projection and at least one radially outwardly directed projection whereby the radially inwardly directed projection and the radially outwardly directed projection are axially spaced with respect to each other. In one embodiment, the one or more interlocking members prevent axial movement of the one or more metallic centralizers with respect to the metallic pipe but permit at least limited rotation of the one or more centralizers with respect to the metallic pipe.

In one embodiment, the one or more metallic centralizers comprise a cylindrical inner surface with a centralizer inner diameter sized to permit at least some axial slippage between the insulative coating and the one or more metallic centralizers for axial positioning of the one or more metallic centralizers with respect to the metallic pipe prior to being axially affixed with respect to the metallic pipe by the interlocking members and the clamp.

In one possible embodiment, the insulative coating is comprised of elastomeric material, the metallic pipe comprises titanium, and the clamp and the one or more interlocking members and the one or more metallic centralizers comprise substantially identical steel material.

Reference to the claims, specification, drawings and any equivalents thereof is hereby made to more completely describe the invention.

BRIEF DESCRIPTION OF DRAWINGS

For a further understanding of the nature and objects of the present invention, reference should be had to the following detailed description, taken in conjunction with the accompanying drawings, in which like elements may be given the same or analogous reference numbers and wherein:

FIG. 1 is an elevational view, partially in cross-section, showing at least a portion of a non-fixed riser connection or stress joint to a wellhead in accord with one possible embodiment of the present invention;

FIG. 2 is an elevational view of a multiple centralizers clamped to a stress joint in accord coated with elastomeric or other suitable coating material with one possible embodiment of the present invention;

FIG. 3 is a cross-sectional view along lines 3—3 of FIG. 2 in accord with one possible preferred embodiment of the present invention;

FIG. 4 is a cross-sectional view along lines 4—4 of FIG. 3 in accord with one possible preferred embodiment;

Figure 5:
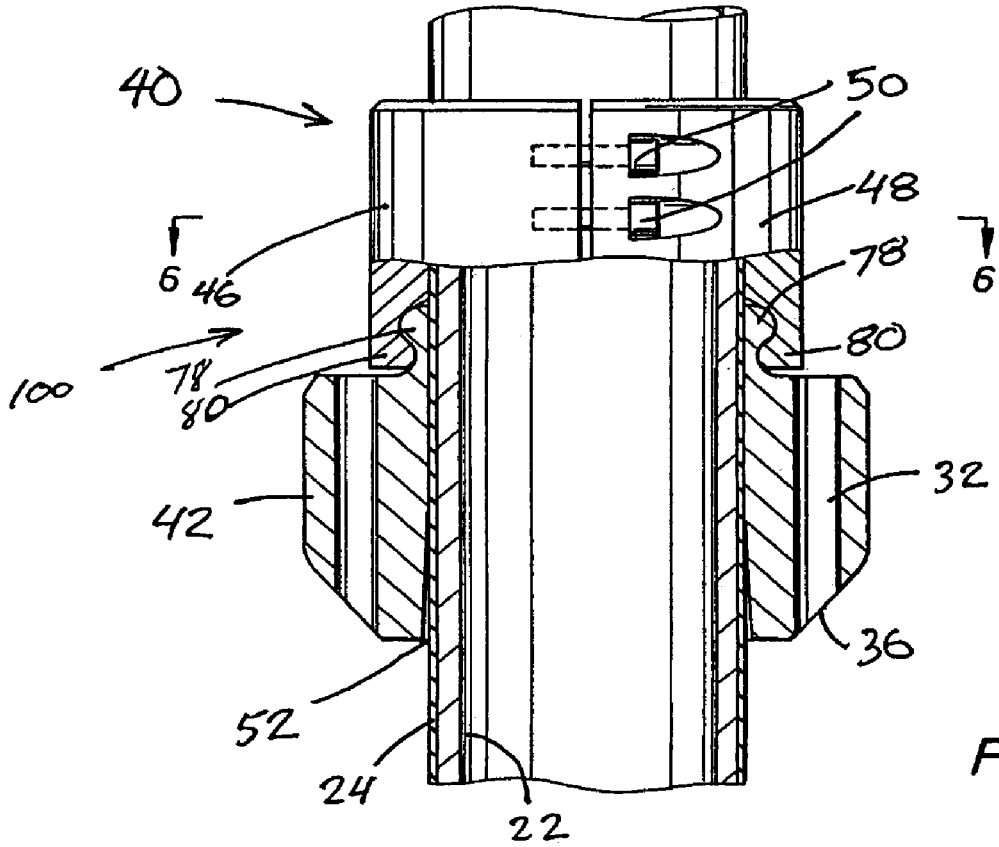
FIG. 5 is an elevational view, partially in cross-section, of a single centralizer clamped to an insulated stress joint in accord with the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PREFERRED EMBODIMENTS

Referring now to the drawings and, more specifically, to FIG. 1, there is shown an example of non-fixed riser connection comprising centralizer system 10 interconnected to wellhead 12 in accord with the present invention. The bending of upper pipe/riser section 14 and lower pipe/riser section 16 above and below centralizers 18 and 20 is the result of loads as applied various types and portions of floating platforms and production vessels which may include without limitation, as examples only, tension leg platforms, spars, barges, ships, and the like (see for Example U.S. Pat. No. 4,185,694) referenced hereinbefore. The pipe which may include upper and lower sections 14 and 16 for insertion into wellhead 12 or a marine receptacle may be referred to herein as a stress joint, and may comprise a titanium stress joint. Due to the various types of floating platforms involved, the types of forces involved with non-fixed riser connections may vary considerably. While pipe/riser sections 14, 16 and centralizers 18 and 20, are shown providing an interconnection with wellhead 12, it will be understood that a coated riser interconnection member with centralizers or titanium stress joint in accord with the present invention may also be utilized for interconnections adjacent the floating platform which may comprise various types of receptacles for insertion of the stress joint within marine structures such as spars, telescoping joints, air cans, hulls, keels, spokes, cages, and other conceivable marine receptacles. Multiple risers may be utilized simultaneously for interconnections with multiple wellheads.

For illustrative purposes of the present invention, the wellhead interconnection shown in FIG. 1 is substantially representative of the general nature of potential lateral/axial/rotational forces of such interconnections for which centralizer system 10 may be utilized. However, centralizer system 10 could also be utilized for other purposes than for stress joints, if desired.

An enlarged view of a portion of centralizer system 10 comprises pipe/riser 22 as shown in FIG. 2 which may comprise a titanium stress joint or steel pipe. In a preferred embodiment, electrically insulative and/or water tight sealing insulative coating 24 such as an elastomeric coating may be utilized on pipe/riser 22 to avoid potential problems with corrosion and/or galvanic action of two dissimilar metals such as steel and titanium. Pipe/riser or stress joint 22 may be comprised of titanium due to preferred mechanical characteristics thereof for resisting the above discussed stresses. Unless electrically insulated by coating 24, the contact of titanium pipe 22 with steel wellhead 12 and/or steel centralizers 18 and 20, which may be comprised of steel may produce undesirable galvanic action which may damage one or both of titanium pipe 22, centralizers 18 and 20, and/or wellhead 12. However, pipe/riser 22 may also be comprised of steel to avoid galvanic action but which would nonetheless remain subject to corrosion, galvanic action due to slight dissimilarities, and cathodic damage. When immersed in an electrolyte, such as soil, water, or concrete, metals, including steel, produce a current which causes ions to leave their surface. The rate of current flow determines the life of the structure. One ampere of current consumes approximately 20 pounds of iron per year. Coating 24 may be comprised of suitable materials, such as elastomerics or other materials discussed hereinafter utilized to slow the damage.

Pipe or titanium stress joint 22 may be of various diameters although an outer diameter OD in the range of about fifteen or so inches would not be unusual. It would also not be unusual that a corresponding centralizer outer diameter OD for wellhead 12 or other conductors in the riser system may be in the range of about twenty-seven inches or so. In this case, centralizers 18 and 20 may have an axial length of about one foot and an internal cylindrical shape to thereby spread stresses with coating 24 over a relatively wide surface area for protective purposes. Centralizers 18 and 20 are preferably one-piece solid metallic members but could be formed in sections, if desired. Clamp 26 shown in FIG. 2 may be approximately two feet long in one preferred embodiment with a large substantially smooth cylindrical interior diameter to further spread stresses over coating 24 to avoid damage thereto.

Due to potential lateral, axial, and rotational physical forces acting on preferably metallic centralizers 18 and 20 as indicated in FIG. 1, which forces may be continuously changing, there is a tendency for preferably metallic steel centralizers 18 and 20 to move axially over time in a manner that is detrimental to operation of centralizer system 10. Corrosion and/or galvanic action may exacerbate the slippage problem. Accordingly, the present invention provides preferably metallic steel clamp 21 positioned between centralizers 18 and 20 shown in FIG. 1.

Shown in greater detail FIG. 2, centralizer system 10 prevents axial movement of the centralizers 28 and 30, with respect to metallic pipe which maybe a titanium stress joint with coating 24. As indicated in FIG. 2, clamp 26 is utilized to secure one or more centralizers, such as upper and lower centralizers 28 and 30, respective, shown in FIG. 2 to pipe 22 having outer insulative coating 24. FIG. 3 shows a more greatly enlarged cross-sectional view of upper centralizer 28 and lower centralizer 30 with physical connections to clamp 26, as discussed hereinafter, as well as insulative coating 24 on pipe 22. In FIG. 4, coating 24 is shown in cross-section in surrounding relationship to pipe 22 in a cross-sectional view that looks down on upper centralizer 28. Centralizer 28 may comprise water flow holes to permit axial movement of the centralizers with respect to an outer tubular, such as wellhead 12 (See wellhead 12 in FIG. 1), without any significant water pressure resistence which may develop due to potentially relatively small annular tolerances which may exist between the outer diameter OD of the centralizers and the inner diameter ID of wellhead 12 or other tubulars in which the centralizers may be utilized. If desired, although not necessarily required, centralizers 28 and 30 may utilize upper and lower beveled guide surfaces 34 and 36, respectively, to permit easier guiding into opening of through possible restrictions in the outer conductors, such as wellhead 12, in which the centralizers may be utilized. Centralizers 28 and 30 may, if desired, comprise slightly flared openings 52 on at least one side therefore for more easily inserting centralizers 28 over insulation material 24 without damage thereto. The internal diameter ID of centralizers 28 and 30 may be slightly larger than the final tightened down ID of clamp 26 and clamp 40, shown in FIG. 5, to permit axial positioning of centralizers 28 and 30 with respect to pipe 22. Thus, it is anticipated that clamp 26 or clamp 40 provides most or virtually all the gripping forces around pipe 22 and coating 24 for resisting axial movement of associated centralizer(s).

Figure 6:
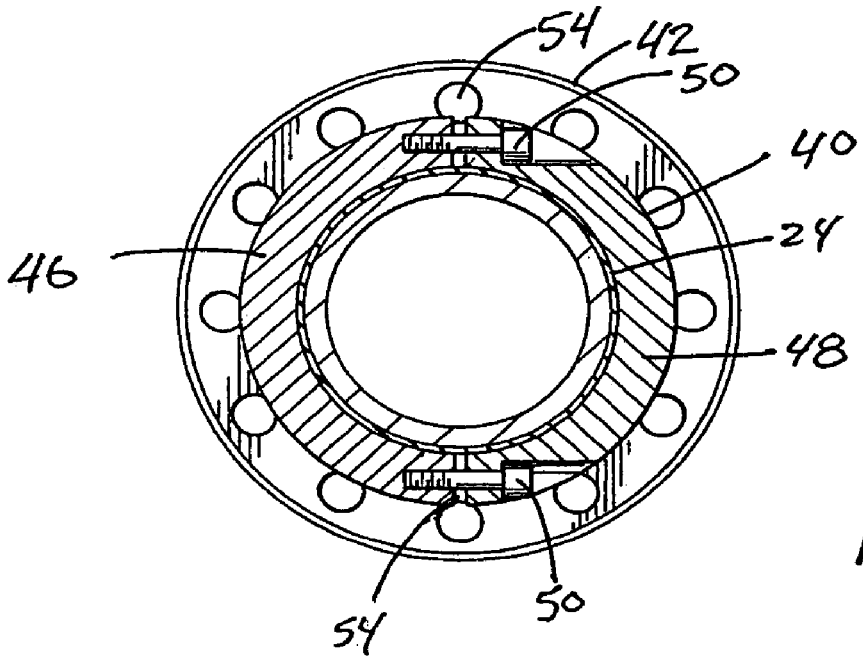
FIG. 6 is a cross-sectional view along lines 6—6 in accord with one possible embodiment of the present invention.

In more detail, FIG. 5 and FIG. 6 show another possible embodiment for a preferred clamp, such as clamp 40, which may be utilized with a single centralizer, such as centralizer 42 that may mounted on pipe/riser 22 with insulative coating 24.

Operation of clamp 40 for a single centralizer and clamp 26 for multiple centralizers is substantially similar. Clamps 26 and 40 may be provided in multi-piece construction, preferably in two-piece construction as best shown in FIG. 6 with first clamp shell 46 secured by fasteners 50, which may be of any suitable type, to second clamp shell 48. While fasteners 50, such as cap screws, threaded bolts, and the like, are utilized on opposite sides, hinges or the like may conceivably be utilized on one side as may be desirable for faster assembly or the like. As well, first clamp shell 46 and second clamp shell 48 may be connected by pins, outer circular clamps such as hose clamps, studs with associated nuts, ratcheting tighteners, or any other suitable means for securely connecting/fastening two or more circular cross-sectioned members to a desired degree of tightness, whereby first clamp shell 46 and second clamp shell 48 are fastened together around coating 24 and pipe 22. First clamp shell 46 and second clamp shell 48 do not necessarily need to form a complete continuous circle around pipe 22 and maybe provided in linked strips if desired. However, the greater surface area provided by the continuously encircling design of clamps 26 and 40 shown herein provide greater protection of typically relatively softer insulative coating 24 which maybe comprised of elastomerics, non-elastomerics, plastics, pliable materials and/or other coatings. Clamps 26 and 40 may be tightened utilizing fasteners to thereby engage coating 24 and may result in some amount of compression of coating 24, but without damaging coating 24.

Referring to FIG. 3, in one possible embodiment for tightening clamps 26 to a particular titanium stress joint 22, a preferred procedure might comprise, lubricating and snugging fasteners 58, 60, 62, 66, 68, 70, 72, 74, and 76 prior to tightening. Gaps 54, shown in FIG. 6, may be adjusted and measured to be of equal width. A torquing sequence designed for the particular materials and sizes involved may then be developed and tested and utilized to torque each fastener to an initial torque. For instance, in one possible embodiment, the torquing sequence of the fasteners 58, 60, 62, 66, 68, 70, 72, 74, and 76 shown in FIG. 3 may involve beginning to apply a first torque, such as 80 foot pounds, beginning with fastener 56, and then continuing to torque each fastener, such as cap screws to 80 foot pounds in the order of particular fasteners 58, 60, 62, 66, 68, 70, 72, 74, and finally 76. The procedure may then require retorquing the fasteners in the same order to a second torque, such as 120 foot pounds. The procedure may then require retorquing the fasteners in the same order to a third torque, such as 170 foot pounds. The above procedures are provided as an example only and it will be understood that depending on the particular design, anticipated forces, particular diameters, types of coatings, pipe sizes, centralizer sizes, and the like, that a desired procedure may vary but thereby results in supplying sufficient inwardly directed forces against coating 24 and pipe 22 to prevent axial movement of centralizers 28 and 30 as significant forces are applied thereto during operation but without damaging coating 24.

As noted earlier, coating 24 may be more compressive, malleable, and/or flexible that the metal utilized for pipe 22. While coating 24 may be a material such as elastomeric, or an insulative non-elastomer, or a relatively pliable or compressible material with respect to metal, coating 24 may also comprise other types of coatings, painted surfaces, and the like, and may even have a roughened outer surface to permit high friction between clamp 26 or clamp 40 and coating 24. In any case, clamp 26 and clamp 40 is tightened to engage coating 24 in a manner that prevents axial movement of clamp 26 and clamp 40 with respect to pipe 22 even when faced with the significant axial, lateral, and/or rotational forces produced thereon by centralizers such as centralizers 28, 30, and 42, as explained in the aforementioned U.S. Pat. No. 4,185,694 for non-fixed connections. It will be noted that the thickness of clamps 26 and clamp 40, as well as that of the centralizers, also support pipe 22 to resist bending forces.

In one presently preferred embodiment, interconnection (s) 100 between the one or more centralizers and the clamp involves the use of interlocking radial projections such as radially outwardly directed projection(s) 78 and radially inwardly directed projection(s) 80 which are axially spaced and interlock together. Because clamps 26 and 40 are preferably the sectioned radially moveable components, end portions of clamps 26 and 40 preferably form the outermost portion of interconnection(s) 100 and are thus in surrounding relationship to axial extending end portions 82 of the collars which preferably extend axially away from the centralizers for interlocking with clamp end portions. It will appreciated that additional and/or fewer radially inwardly and/or radially outwardly projections may be utilized. Moreover, if desired, only radially inwardly projections may be utilized or only radially outwardly projections may be used. Projections 78 and 80 preferably have mating or substantially mating receptacle surfaces. In the preferred embodiment, the mating surfaces may be rounded or radiused, but other mating cross-sectional projection surfaces such as rectangular, square, triangular, or mating connections may be utilized. For that matter, individual projections such as studs/receptacles may also be utilized.

Note in the present embodiment, that some rotation of the centralizer(s) with respect to the clamp(s) is possible without loss of the resistance to axial movement provided by the clamps providing for a strong but more flexible interconnection. If desired, splines (not shown) or other mechanical interconnections might be utilized to prevent any possible rotation between the clamp(s) and the centralizer(s).

While the above description provides the presently preferred embodiments other types of mechanical connections and/or clamp tightening means may conceivably be utilized. However in a preferred embodiment, at least one clamp portion is provided for clamping to pipe 22 without damaging coating 24 and an interconnection is then required between the clamp portion and the centralizers to prevent axial movement of the centralizer. As one alternative example, interconnections 100 may be separate components from one of the centralizer(s) the or clamp(s) or both. Thus, interconnections 100 may also comprise additional split rings, bolted connections, or the like. Other possible interconnections may include flanges or threaded connections. However, threaded clamp/centralizer interconnections might have a tendency to back off and come loose in response to forces applied over time and may also be more likely to cause damage to coating 24 during rotation and connection thereto and/or during radially inwardly tightening mechanisms. Welded interconnections may tend to damage coating 24 due to heat generated thereby.

It will be noted that the clamps, such as clamps 26 and 40 may also have various coatings, sealers, laminations, applied thereto in some suitable manner to prevent corrosion thereof. Likewise, interconnections 100 between the centralizer(s) and clamp(s) may utilize coatings, sealers, and the like, to reduce any corrosion therebetween and the clamp(s) and centralizer(s) may preferably be comprised of the same metallic materials to prevent galvanic reactions therebetween.

Accordingly, the present invention provides centralizer system 10 which may be utilized with pipe 22 having insulative coating 24. One or more centralizers, such as centralizers 28, 30, or 40, which may preferably have an internal cylindrical inner diameter that permits at least some slippage over insulative coating 24 to thereby position the centralizer(s) in a desired axial position with respect to pipe 22. Clamps 26 or 40 are comprised of multiple cylindrical segments such as segments 46 and 48 which can be tightened against coating 24 to thereby fix the clamp in axial position with respect to pipe 22. Interconnection(s) 100 then interconnect one or more centralizers to the clamp to thereby axially affix the centralizer with respect to pipe 22.

While clamp system 10 shows a maximum of two centralizers, multiple clamps could be utilized between multiple centralizers. For instance, two clamps may be utilized between three centralizers utilizing the interconnection structures illustrated herein.

As used herein titanium comprises titanium itself as well as alloys thereof. Coating 24 may be of various types such as elastomerics or other suitable insulative materials some of which may be at least somewhat flexible, compressible, resilient, and/or at least more pliable than steel. Coating 24 may be relatively thick as desired. Coatings 24 may also comprise composite materials that are electrically nonconductive and provide high load-bearing, fatigue-resistant interface between pipe 22 and the centralizers and clamp. The composite can be comprised of reinforcing filler supported in a polymeric matrix selected from a group consisting of thermoplastic resins, thermosetting resins, and mixtures thereof. Non-limiting examples of reinforcements thereof may comprise fibers such as glass fibers, aramid fibers, boron fibers, continuous fibers. Fiber reinforced coatings may be laminated and/or molded.

The foregoing disclosure and description of the invention is therefore illustrative and explanatory of a presently preferred embodiment of the invention and variations thereof, and it will be appreciated by those skilled in the art that various changes in the design, organization, order of operation, means of operation, equipment structures and location, methodology, and use of mechanical/insulative/cathodic equivalents, as well as in the details of the illustrated construction or combinations of features of the various elements, may be made without departing from the spirit of the invention. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. As well, the relative size and arrangement of the components may be greatly different from that shown and still operate within the spirit of the invention as described hereinbefore and in the appended claims. It will be seen that various changes and alternatives may be used that are contained within the spirit of the invention.

Accordingly, because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

What is claimed is:

1. A centralizer system positioned in a marine riser system for a wellbore and a floating platform, at least one of said wellbore or said floating platform comprising a receptacle for receiving said centralizer system, said receptacle comprising a receptacle inner diameter, said centralizer system being operable for withstanding stresses produced by relative movement between said wellbore and said floating platform as well as water movement, said centralizer system comprising:

a metallic pipe comprising a pipe outer diameter less than said receptacle inner diameter so as to be insertable into said receptacle and relatively moveable within said receptacle;

an insulative coating in surrounding relationship to said metallic pipe, said insulative coating being operable for reducing at least one of corrosion or a galvanic reaction in the region of said receptacle and said metallic pipe when said metallic pipe is inserted therein;

one or more metallic centralizers mounted on said metallic pipe, said insulative coating being annularly positioned between said one or more metallic centralizers and said metallic pipe, said one or more metallic centralizers having a centralizer outer diameter less than said receptacle inner diameter but greater than said pipe outer diameter;

a clamp comprising at least two sections, said at least two sections comprising internal surfaces for engaging said insulative coating around said metallic pipe;

one or more fasteners for said clamp operable to tighten said internal surfaces of said at least two sections with respect to each other against said insulative coating such that said at least two sections of said clamp are axially fixed in position with respect to said metallic pipe; and one or more interlocking members for interlocking said at least two sections of said clamp with respect to said one or more metallic centralizers to thereby prevent axial movement of said one or more metallic centralizers with respect to said metallic pipe.

2. The centralizer system of claim 1, wherein said internal surfaces of said at least two sections of said clamp are cylindrically shaped.

3. The centralizer system of claim 1, wherein said one or more metallic centralizers comprise a cylindrical inner surface with a centralizer inner diameter sized to permit at least some axial slippage between said insulative coating and said one or more metallic centralizers for axial positioning of said one or more metallic centralizers with respect to said metallic pipe prior to being axially affixed with respect to said metallic pipe by said interlocking members and said clamp.

4. The centralizer system of claim 1, wherein one or more interlocking members prevent axial movement of said one or more metallic centralizers with respect to said metallic pipe but permit at least limited rotation of said one or more centralizers with respect to said metallic pipe.

5. The centralizer system of claim 1, wherein said insulative coating is more compressible than said metallic pipe.

6. The centralizer system of claim 1, wherein said insulative coating is comprised of elastomeric material.

7. The centralizer system of claim 1, wherein said one or more metallic centralizers further comprise only one metallic centralizer.

8. The centralizer system of claim 1, wherein said one or more metallic centralizers are of one-piece monolithic construction.

9. The centralizer system of claim 8, further comprising a plurality of axial bores formed within said one or more metallic centralizers to permit fluid flow therethrough.

10. The centralizer system of claim 1, wherein said clamp has an axial length at least as great as an axial length of one of said one or more metallic centralizers.

11. The centralizer system of claim 1, wherein said one or more interlocking members comprises at least one radially inwardly directed projection formed on an inner surface of said clamp, each of said one or more centralizers comprising an outer surface defining a receptacle for receiving said radially inwardly directed projection.

12. The centralizer system of claim 1, wherein said one or more interlocking members comprises at least one radially outwardly directed projection formed on an outer surface of each of said one or more centralizers, said clamp further comprising an inner surface defining a receptacle for receiving said radially outwardly directed projection.

13. The centralizer system of claim 1, wherein said one or more interlocking members comprises at least one radially inwardly directed projection and at least one radially outwardly directed projection, said radially inwardly directed projection and said radially outwardly directed projection being axially spaced with respect to each other.

14. The centralizer system of claim 1, wherein said one or more interlocking members further comprises at least one radially projecting member integral with at least one of said clamp or with said one or more centralizers.

15. The centralizer system of claim 1, wherein said metallic pipe comprises titanium.

16. The centralizer system of claim 15, wherein said one or more metallic centralizers comprise steel material.

17. The centralizer system of claim 16, wherein said clamp and said one or more interlocking members and said one or more metallic centralizers comprise substantially identical steel material.

* * * * *